United States Patent [19]

Jackson

[11] 4,128,947

[45] Dec. 12, 1978

[54] PROCESS AND APPARATUS FOR DRYING TEXTILE STOCK AND THE LIKE

[76] Inventor: Harry C. Jackson, 2120 Country Club Rd., Columbus, Ga. 31906

[21] Appl. No.: 760,456

[22] Filed: Jan. 19, 1977

[51] Int. Cl.[2] ..... F26B 7/00; F26B 19/00

[52] U.S. Cl. ..... 34/12; 34/18; 34/60; 34/70; 34/145

[58] Field of Search ..... 34/12, 17, 18, 60, 69, 34/70, 14, 145

[56] References Cited

U.S. PATENT DOCUMENTS

| | | | |
|---|---|---|---|
| 1,726,373 | 8/1929 | Voightlander | 34/70 X |
| 1,937,860 | 12/1933 | Watkins | 34/70 X |

*Primary Examiner*—John J. Camby
*Attorney, Agent, or Firm*—Hugh P. Carter

[57] ABSTRACT

A process and apparatus for drying textile stock and the like which assures even, thorough and quick drying of a batch of stock. The process embodies the steps of passing heated air under pressure through the stock along a multiplicity of paths so that the air will not channel itself, but passes through the stock substantially completely in contact with all of the wet fibers. A second feature of the process is the concept of pressing the stock while passing heated air through the same along a multiplicity of paths. The process is further characterized by engaging a column of the stock between two platens, both of which are perforated and one of which is movable and applying a head of heated air under pressure above the movable platen so that the pressure of the air causes the platen to act somewhat as a piston, the air also being forced through the holes in the movable platen to pass through the stock along a multiplicity of substantially discrete paths. The apparatus comprises the perforated, stationary and movable platens together with means to maintain a head of heated air above the movable platen, thus to cause it to act as a compression member on the stock, as well as means for directing air through the stock along a great number of paths.

3 Claims, 3 Drawing Figures

PROCESS AND APPARATUS FOR DRYING TEXTILE STOCK AND THE LIKE

My invention relates to a process and apparatus for drying textile stock and the like, for instance, to dry such stock after it comes from the dyeing or bleaching process, or any other process in which the fiber results in the fiber being wet and to be used, of necessity must be dried.

Heretofore in this art processes for drying textile fibers and like stock, after dyeing, or otherwise coming from a wet process, have not been entirely satisfactory. Many attempts have been made to fluff up the stock, while it is being passed along belts, conveyors and the like, and to blow air over the same in an attempt to make the air penetrate the masses of fibers thus to dry the same. Tower-type dryers have been employed to some extent and various other mechanisms and processes have been employed. So far as I am aware all of these have required an inordinate amount of time, effort and expense to dry the stock, when compared to the invention to be disclosed herein.

In view of the foregoing a prime object of my invention is to provide a process and apparatus for drying textile stock and the like which shall be economical both in terms of the amount of labor and energy required and which shall assure quick, thorough, even drying of the stock.

More specifically, my improved process contemplates placing a batch of the wet stock in a kier and to provide means to pass heated, drying air through the stock along a multiplicity of substantially discrete paths, thus to assure even, thorough drying of the stock.

Another object is to provide a process of the character designated in which the stock is placed in a closed kier with the stock being supported therein on a perforated base or support member, there being a perforated plate simply laid on top of the mass or column of fibers so that, upon supplying heated air under pressure above the plate just mentioned, such air not only is directed through the stock along a multiplicity of paths (due to the perforations in the plate), but also causes the plate to act as a sort of piston which physically presses upon the mass, thus to force some of the liquid out of the same into the bottom of the kier for removal.

A further object is to provide apparatus of the character designated in which the aforementioned perforated, movable plate is made slightly less in overall size than the inside dimensions of the kier so that when pressure is applied the stock tends to bulge up around the periphery of the plate, thus to make the same self-sealing and to assure that the plate does not cant and become stuck in the kier.

Further and more detailed objects are to provide apparatus of the character designated in which a closed kier is employed; to provide means for removing the moisture laden air and liquid from the bottom of the kier; and in general to provide apparatus which shall be efficient, economical, and fully capable of carrying out my improved process.

Apparatus illustrating features of my invention and which may also be used to carry out my improved process is shown in the accompanying drawings forming a part of this application in which.

Figure 1:
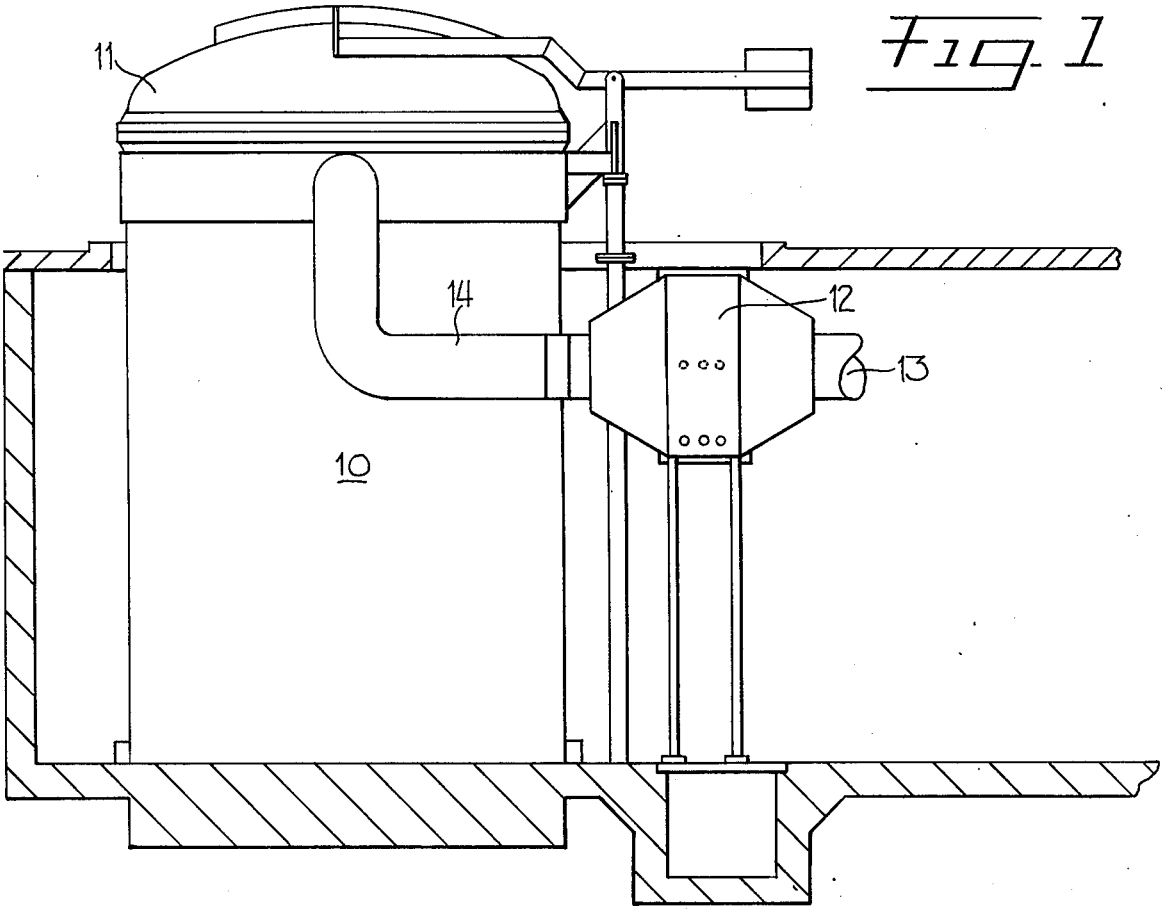
FIG. 1 is a side elevational view, partly in section, showing a kier incorporating features of my invention.

Referring now to the drawings for a better understanding of my invention I show a kier indicated generally by the numeral 10 which as understood may be a round stainless steel pressure vessel having a removable cover 11. The cover is held in closed position by a plurality of hold-down means which have been omitted from the drawing for the sake of clarity. However, it will be understood that the cover is held on the kier so that air under pressure may be supplied as will be explained to the top portion of the kier.

Figure 2:
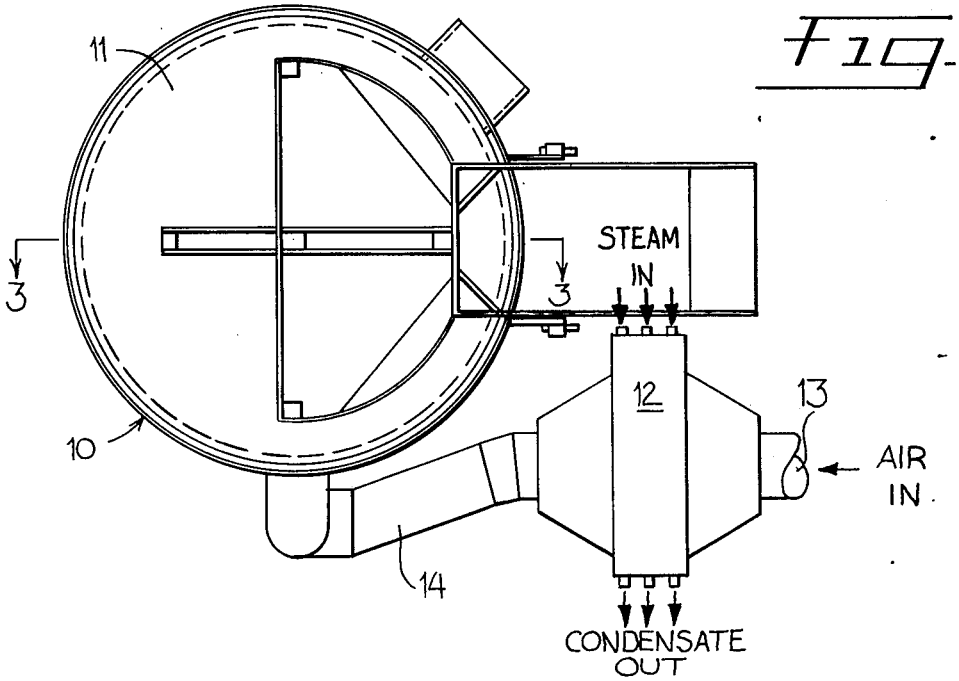
FIG. 2 is a plan view of the kier shown in FIG. 1.

At 12 I show a heater which surrounds an air supply conduit 13. Steam may be admitted to the heater as indicated in FIG. 2 and the condensate may be discharge also as indicated. Suffice it to say that I show diagrammatically a form of heater which is adequate to heat a considerable volumn of air under pressure. Such air is carried in a conduit 14 and discharged through an opening 15 into the top of the kier, above the stock as will presently appear.

Figure 3:
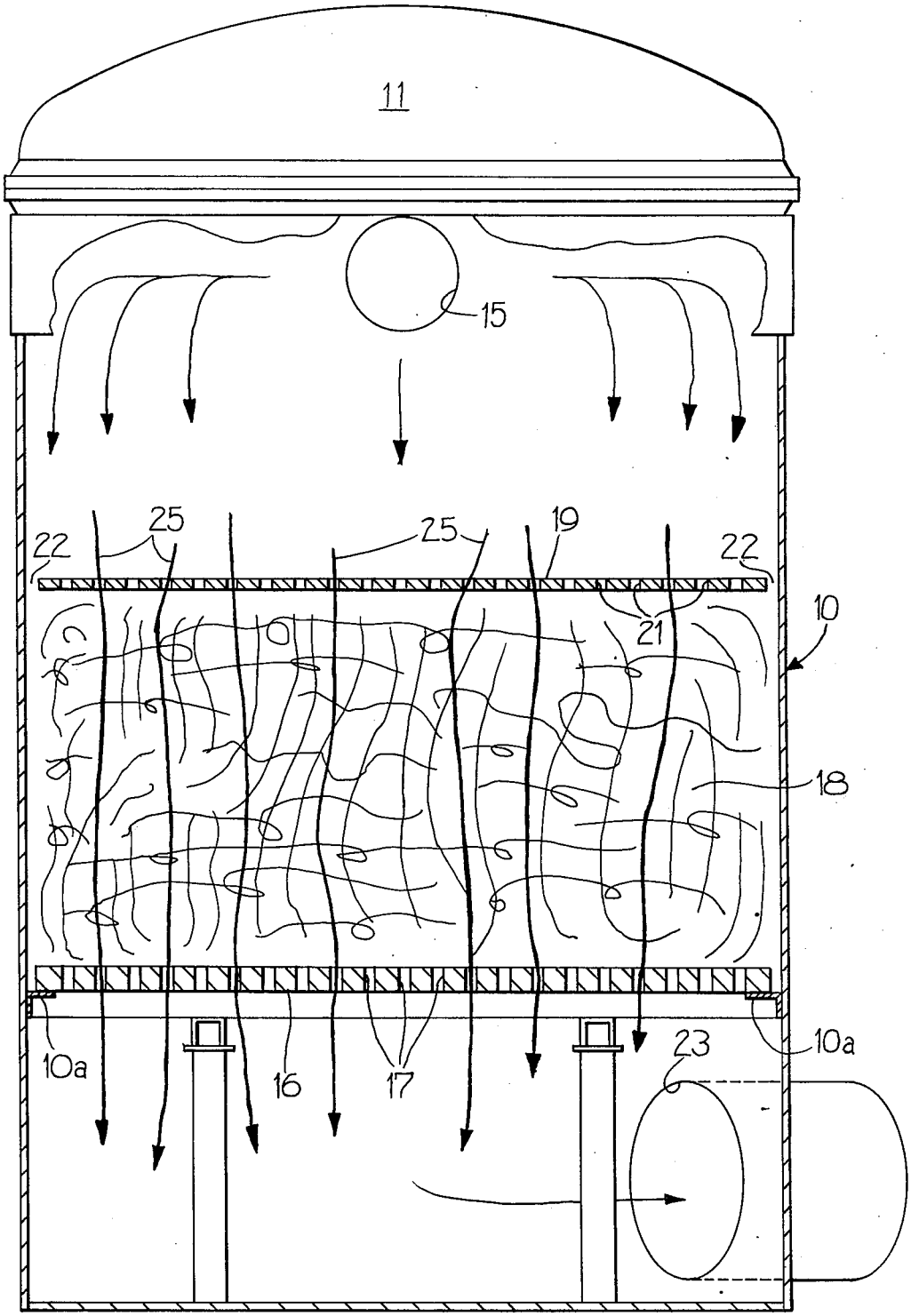
FIG. 3 is an enlarged vertical sectional view taken generally along line 3—3 of FIG. 2.

Referring particularly to FIG. 3, the kier 10, as stated, may be a round vessel. Mounted on suitable supporting framework **10*a* is a relatively heavy plate 16 (which may be the rack on which the stock was dyed) and preferably made of stainless steel and perforated as indicated by the openings 17. The plate 16 forms a stationary support, base or platen for a quantity of stock indicated at 18** which is to be dried.

Simply laid upon the top surface of the column of stock 18 is a second plate or platen 19 which is perforated throughout its extent as indicated by the numeral 21. It will be noted that plate 19 is slightly less in diameter than the inside dimension of the kier so as to provide an all-around, slight clearance indicated by the numeral 22.

The bottom of the kier, beneath the platen 16 is provided with an opening 23 through which the moisture laden air and liquid pressed from the stock as will be explained may be discharged from the kier.

From the foregoing description of the apparatus my improved process as well as the advantages of my improved apparatus may now be explained more fully. First, and by way of example, I have carried out my improved process in a kier which was 92 inches inside diameter by approximately eleven feet from the base on which the kier sits up to the cover 11. The platen or plate 16 may be the raw stock dyeing rack just on which the column of stock was supported in the dyeing apparatus. I have charged the above sized kier with as much as 3,000 pounds of wet material. With a kier of the size mentioned I have used heated air from 300° F. to 400° F. in a volume of about 1,800 to 2,000 cubic feet per minute. The perforated plate 19 was a steel plate approximately ⅜ths inch in thickness having holes about ½ inch in diameter throughout its entire surface.

With the charge of material in place in the kier, resting on the perforated rack or plate 16 and with the perforated plate 19 in place, the vessel is closed. Air from the conduit 13 is supplied into the top of the kier, above the plate 19 at a temperature of 300° to 400° F. With a charge of stock weighing approximately 3,000 pounds when wet, a pressure of 9 or more inches, gauge, in the upper portion of the kier, will force about 1,800 to 2,000 cubic feet per minute of air through the stock. It will be particularly noted as indicated by the arrows 25 that the air passes through the stock along a multiplicity of substantially discrete paths. That is to say, due to the provision of the perforated plate 19 pressure in the top of the kier not only forces the plate downwardly toward the support or base 16 thus to press water from the stock, but the perforations 21 cause the air to enter the stock at a multiplicity of separate places, namely, prevents the air from channelizing.

The fact that plate 19 is slightly less in a diameter than the internal dimensions of the kier causes it to become forced slightly down into the stock, whereby around the edges of plate 19 the stock occupies the spaces indicated at 22, forming a sort of seal completely around the plate 19. Liquid pressed out by the force of plate 19 on the stock drains through opening 23 and the moisture laden air is discharged therefrom, also.

My invention is characterized by the fact that the wet stock, just as it comes from the dye house is evenly and quickly dried without having to separate or disturb the fibers as by fluffing, agitating, or the like. It appears that the great multiplicity of relatively discrete air streams passing through the stock afford a much more efficient drying than is obtainable by such prior method of drying as fluffing the stock and blowing air through it. My observations with regard to my improved process and apparatus indicate that as the moving streams of air dry the fibers, moisture in adjacent fibers or groups of fibers gravitates toward the just dried fibers, thereby in effect evening out the entire drying process, completely throughout the mass of stock. The pressure on plate 19 of course holds that plate in good, firm contact with the top of the mass of fiber so that the initiation of the relatively discrete, multiplicity of flow paths is automatically established.

In view of the foregoing it will be seen that I have devised an improved process and apparatus for drying textile stock and similar materials. While I have specifically disclosed textile stock herein, it will be apparent that other types of materials may with equal facility be dried by my improved process and apparatus.

What I claim is:

1. The process of drying textile stock and the like which comprises:

(a) supporting a column of the stock in a closed vessel on a liquid and air permeable base, (b) placing a floating, air permeable plate on top of the column of stock to be dried, (c) closing the vessel to provide an air space above said plate, and (d) supplying said air space with heated air under pressure, whereby the plate is forced downwardly against the base, thus to compress the stock and heated air passes through the plate, stock and base, along a plurality of paths.

2. The process of claim 1 which comprises removing from the vessel liquid which is pressed from the stock while the same is being subjected to said air under pressure.

3. In apparatus for drying textile stock and the like, (a) a kier provided at its top with a removable, airtight cover, (b) a fixed, air permeable plate in the kier adapted to support a column of the stock to be dried, (c) an air permeable, floating plate adapted to be placed on top of the stock and which is slightly less in size than the inside dimensions of the kier, (d) means to maintain heated air under pressure above the floating plate whereby the same is forced downwardly thus to compress the stock and also to cause heated air to flow downwardly through the stock along a multiplicity of paths, and (e) means to remove the air from the kier after it passes through the column of stock.

* * * * *